US007478962B2

(12) United States Patent
De Laforcade

(10) Patent No.: US 7,478,962 B2
(45) Date of Patent: Jan. 20, 2009

(54) DEVICE FOR PACKAGING AND APPLICATION OF A PRODUCT

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 502 days.

(21) Appl. No.: 11/137,585

(22) Filed: May 26, 2005

(65) Prior Publication Data

US 2005/0265773 A1 Dec. 1, 2005

Related U.S. Application Data

(60) Provisional application No. 60/577,168, filed on Jun. 7, 2004.

(30) Foreign Application Priority Data

May 26, 2004 (FR) ..... 04 51031

(51) Int. Cl.
*B05C 21/00* (2006.01)

(52) U.S. Cl. ..... 401/262; 401/202

(58) Field of Classification Search ..... 401/198, 401/202, 262

See application file for complete search history.

(56) References Cited

U.S. PATENT DOCUMENTS

| | | | | |
|---|---|---|---|---|
| 3,377,124 | A * | 4/1968 | Hiroyuki | 401/198 |
| 3,482,920 | A * | 12/1969 | Schwartzman | 401/132 |
| 3,860,348 | A | 1/1975 | Doyle | |
| 4,781,484 | A * | 11/1988 | Goncalves | 401/132 |
| 4,957,385 | A * | 9/1990 | Weinstein | 401/132 |
| 5,098,297 | A * | 3/1992 | Chari et al. | 433/215 |
| 6,386,781 | B1 * | 5/2002 | Gueret | 401/198 |
| 2004/0052568 | A1 | 3/2004 | Gueret | |

FOREIGN PATENT DOCUMENTS

| | | |
|---|---|---|
| EP | 1 382 541 A1 | 1/2004 |
| FR | 2 492 241 | 4/1982 |
| FR | 2 610 300 | 8/1988 |
| GB | 2 084 455 | 4/1982 |
| GB | 2 084 455 A | 4/1982 |
| GB | 2 292 928 | 3/1996 |
| JP | 57-81307 | 5/1982 |
| JP | 2004-49916 | 2/2004 |

* cited by examiner

*Primary Examiner*—David J Walczak
(74) *Attorney, Agent, or Firm*—Oblon, Spivak, McClelland, Maier & Neustadt, P.C.

(57) ABSTRACT

An applicator and packaging device including a container forming a recess containing a measured quantity of product and delineating an opening capable of communicating with the recess. The container is integral with a porous applicator in an illustrated example. When the opening is closed by a cover strip, the applicator is at least partially disposed in the recess, and emerges at least partially through the opening when the container is in the open position. The cover strip is integral with a support of greater rigidity than that of the cover strip and extends at least partially around the opening.

49 Claims, 2 Drawing Sheets

DEVICE FOR PACKAGING AND APPLICATION OF A PRODUCT

CROSS-REFERENCE TO RELATED APPLICATIONS

This document claims priority to French Application Number 04 51031, filed May 26, 2004 and U.S. Provisional Application No. 60/577,168, filed Jun. 7, 2004, the entire content of which are hereby incorporated by reference.

FIELD OF THE INVENTION

The invention relates to packaging and applicator devices for a product, such as a cosmetic or skin care product. The invention can be particularly advantageous for providing a transportable device for a small quantity of product. In accordance with a preferred example, a device according to the invention can facilitate the testing of sensitivity to hair coloring products as recommended prior to the application of these products, in particular when oxidation coloring or direct coloring is concerned.

BACKGROUND OF THE INVENTION

Discussion of Background

In the field of cosmetics or skin care, it is commonplace to package products in "single dose" form. Such packaging is frequently used for samples intended for example to enable customers to test the products. Such packaging can also be readily carried in a handbag thereby avoiding the need to take a bottle or pot that may be cumbersome and difficult to transport for an entire day or weekend.

Sachets containing liquid or cream used for example as samples already exist. However, such sachets are not easy to open as the product tends to escape from the sachet as it is torn during opening. Moreover, such packaging can require the fingers to be used to apply the product, which is not always desirable given that this type of product is commonly used away from a bathroom and it is often not possible or not convenient to wash one's hands after applying the product.

Sachets containing wipes impregnated with a liquid also exist. Such sachets are easier to use, and in particular they are easier to open by virtue of the fact that the product is retained in the wipe. However, here again, the fingers are in contact with the product during application.

U.S. Pat. No. 3,860,348 discloses a known single-use packaging and applicator device, including a container inside which is mounted a foam element impregnated with a product to be applied. The container is closed by a cover strip designed to hermetically seal the device. To facilitate application, the user holds the device in one hand, and uses the other hand to peel off the cover strip. This cover strip presents a grasping zone projecting slightly beyond one edge of the container on which it is sealed, to facilitate handling. This grasping zone is generally small in size, and it is difficult to peel back the cover, particularly when the hands are not dextrous. Furthermore, the manipulation required to peel back the cover involves taking hold of the grasping zone and drawing it towards a diametrically opposite point on the container. The user's fingers are therefore very close to the opening defined by the container. Given that the foam element is compressed inside the container, it will start to decompress as soon as the opening action begins. The user's fingers are therefore liable to come into contact with the foam applicator surface, thereby soiling it and becoming soiled themselves.

There is a need for a new opening action that is also possibly easier to perform, in particular when the packaging and dispensing devices to be opened are of very small size.

SUMMARY OF THE INVENTION

It is an object of the invention to provide a device that is of compact size and readily transportable.

A further object of the invention is to provide a device which enables practical application of the product, and which is easy to open without soiling the user's fingers, and without contaminating the product with the fingers even before the first use.

The invention provides an applicator and packaging device including a container forming a recess containing a measured quantity of product and delineating an opening capable of communicating with the recess. In one example, the container is integral with a porous applicator which, when the opening is closed by a cover strip, is at least partially disposed in the recess, and which emerges at least partially through the opening when the container is in the open position. The cover strip is integral with or associated with a support of greater rigidity than that of the cover strip and the support extends at least partially around the opening. Preferably, the support provides a frame for grasping to allow removal of the cover strip and preferably the support extends around entire opening. With the support providing a frame for the cover strip as in the illustrated examples, movement of the support causes movement of the cover strip to remove the cover strip from the container and open the container.

By way of example, the user can open the device by using one hand to hold the support, which can form a grasping element against which the cover strip is applied. Using the other hand, the user can easily detach the container from the support, thereby separating the container opening from the cover strip. The user has no need to directly grasp the cover strip in order to expose the container opening. Furthermore, the user's hands can at all times be held some distance from the applicator, with the separating action of the container and cover strip causing the hands to move apart, thereby avoiding unwanted contact between the hand holding the support and the applicator.

In effect, both hands move apart without either of the two hands necessarily having to pass across the container opening. Separation can be accomplished by holding one of either the container or the support in a fixed position, while the other of either said container or said support is caused to rotate about an axis intersecting with and preferably parallel to the plane in which the opening is defined. When the user imparts to the container or support a rotational movement about an axis defined in the plane of the opening, and given that the opening action according to the invention requires an ample movement of hands as they move apart, the risk of fouling (or contaminating) the applicator is minimized as the hands are positioned some distance from the opening.

The user can thus apply the product by holding the container integral with the applicator without the fingers having come into contact with the applicator, and without the product having soiled the fingers.

Advantageously, the applicator is preferably resiliently deformable. For example it can be compressed in the recess by the cover strip such that the cover strip is held taut against the applicator in the closed position.

Preferably, in the closed position, the applicator is compressed in a direction of a lengthwise axis of the container, between a bottom of the recess and the cover strip. For example, a length of the applicator at rest can be greater than a depth of the recess defined from the opening of the recess.

In one embodiment, by way of example, the applicator occupies the entire internal volume of the container. The product in this case is impregnated in the applicator. Preferably, the quantity of product held in the container is such that it does not saturate the entire applicator, but a maximum of 90% of the latter.

Advantageously, the applicator is an open-cell foam, for example. As a variant, the applicator is made of a semi-open cell foam, felt or agglomerate material. In particular, the applicator can be made from one or more materials selected from polyurethanes, polyesters, polyethers, polyvinyl chlorides, and ethylene vinyl acetates. For example, the applicator can be made of cotton, in this case covered by an elastomer film at least partially perforated to allow the product to pass through. The applicator can also be made of a flock material.

The applicator can have a composite structure, for example formed from an assemblage of foam elements of different types and/or density. As a variant, the applicator can present zones of variable porosity so as to regulate the flow of product through the applicator. Furthermore, the applicator can optionally be made in a hydrophilic or lipophilic material depending on the product absorbed by the applicator, thereby promoting absorption of the product into the applicator. It can also advantageously contain a preservative or bactericidal agent.

The applicator presents an application surface that can be adapted to the skin surface against which it is to be applied. For example, the application surface can form a dome. In one embodiment of the invention, the surface area of the application surface is, for example, on the order of 7 $mm^2$.

In one example, the applicator can be welded to a wall of the container, for example, a wall set back from an edge delineating the opening. Also by way of example, the applicator can be thermally welded, or by ultrasonic or high frequency welding for example.

Alternatively, the applicator can be held on the container by means of an adhesive composition, or by fusion of the material. As a variant, the applicator can be compressed radially in the container, and this compression can contribute towards retaining the applicator in the container.

Preferably, the cover strip provides a leaktight closure of the opening. The cover strip can be, for example, hot or cold bonded, or welded onto the container. Opening of the device by peeling off the cover strip is then irreversible, i.e. definitive. A device intended for example for single use can thus be obtained. Advantageously, the weld or bond line defined between the cover strip and the container is annular and continuous.

Advantageously, the cover strip can be made of a barrier material resistant to the external environment to avoid contamination of the product and/or the applicator held in the recess in the sealed position. For example, the cover strip can include one or more layers of at least one of the materials such as for example a thermoplastic material selected in particular from polyethylenes, polypropylenes, polyethylene terephthalates and polyvinyl chlorides, or a metallic material selected for example from aluminium, aluminium alloys and brasses, or a metal-plastic composite, or paper.

In an illustrated example, the support is attached to the cover strip. For example, the cover strip can be heat welded or heat sealed against the support, and irreversibly integral therewith. As the support is rigid, grasping the support in one hand enables the container to be maintained in a given position. When the user causes the container to move relative to the support with the other hand, the contact between the cover strip and the container is then broken, and the cover strip remains integral with the support when the contact with the container is broken.

The support can be for example cut by means of a die-cutter, or molded from a thermoplastic polymer, for example polypropylene, or polyethylene or polyamide or polystyrene. The support preferably has a flat structure with a thickness on the order of 1 mm to 10 mm.

Preferably, the support has an aperture through which the container can be mounted such that its opening is closed off by the cover strip. By way of example, the support and the container can be held on the same side of the cover strip. Thus, for example, the cover strip can be coated on one side with a layer of varnish capable of locally cooperating respectively with the support and one edge of the container delineating the container opening to facilitate heat welding or heat sealing respectively to said cover strip. This varnish layer melts at the surface when heated at the points of contact with the support and the container. After cooling, the weld is then definitively formed.

For example, this aperture can present an inner periphery counterpart to the outer periphery of the container at the level of the opening. Preferably, the size of the aperture in the support is larger than the outer periphery of the container so as to prevent the container from sticking in the aperture when the container is detached from the cover strip.

As a variant, the inner periphery of the aperture can be made to fit this outer periphery, so as to strengthen the hold of the container relative to the cover strip if need be. For example, the container can be set perpendicular to the cover strip, and the support can then participate in holding the position of the container by virtue of its thickness and its close-fitting aperture.

This aperture and the outer periphery of the container adjacent to the opening are of circular cross-section for example.

By way of example, the container can include resiliently deformable walls. For example, the container can be formed from a metallic material, in particular aluminium, a metal-plastic composite, and/or a thermoplastic material, for example obtained by stamping, thermoforming or thin-wall injection molding. Also by way of example, the material can be one or more materials selected from polyethylenes, polypropylenes, polyethylene terephthalates, polyvinyl chlorides, polyacrylates, or polyamides. The container can also be made of glass, and in this case have rigid walls. The walls of the container can be transparent.

At an inner wall of the container, with this inner wall at least partially defining the recess, the container can include retaining means capable of cooperating with the outer periphery of the applicator. These retaining means are for example spikes or hooks capable of engaging mechanically with the applicator by penetrating more or less deeply into said applicator.

For example, the quantity of product can be between 0.5 and 20 mL, and preferably less than 1 mL. The product can include at least one component of a formulation intended to color keratinic fibres and in particular the hair. According to one example of the invention, a hair coloring system is provided which enables a patch test of the coloring product to be carried out, in a simple and economical manner, before the product is used. As coloring products generally have a strong color, the device according to the invention makes it possible to avoid soiling the fingers with long-lasting stains when applying the patch test.

The term "hair colorant" can include a direct colorant or a coloring precursor such as an oxidation base or a coupling agent, and preferably that is soluble in a hair coloring medium formed by water or a mixture of water and at least one organic solvent.

As a variant, the product can be, for example, a composition for the treatment of localized skin infections, such as acne or cold sores. As a further variant, the product can be a cosmetic product in the form of a liquid, a gel, a cream or a powder, or a perfume.

Preferably, the product is impregnated into the applicator, and placement of the applicator in contact with a surface to be treated causes the product to pass through the applicator, for example by capillary action, so as to be transferred onto said surface.

Another object or example of the invention provides a product packaging and applicator kit including a plurality of devices according to the invention. For example the devices can be connected together, at least in pairs, by one or more breakable portions at least defined at the level of the support. Such an embodiment makes available to the user several doses of product with individualized packaging and applicator devices which can be separated so that a desired number of doses can be carried. Again by way of example, the support can be a single element and can include a plurality of containers sealed by a single cover strip integral with the single support. The containers are then welded to said cover strip through a plurality of apertures in the support for example.

The invention also relates to the use of a device according to the invention wherein a rotational movement is imparted to the container relative to the support, in particular about an axis parallel to this support, so as to detach the cover strip from the opening. Then, as the applicator decompresses after separation has occurred between the container and the cover strip, the user can apply an application surface of this applicator, projecting beyond the container opening, onto a surface to be treated. As it expands, the applicator can pump any residual product present in the closed volume and all of the product can then be held by impregnation in the applicator such that it is not liable to flow out of the device. The product can be pumped by mechanical means and/or by capillary action and can lodge for example in the pores of the applicator.

Generally, in order to release the product impregnated in the applicator in contact with the surface to be treated, the applicator is pressed lightly against this surface.

According to a preferred example, the devices according to the invention are intended for single use, and are intended to be discarded after application against the surface to be treated.

To manufacture such devices according to the invention, the applicator is preferably mounted in the recess and the recess is filled with product by means of a syringe, for example, with the recess opening being placed uppermost (or open at the top) so that the product remains in the recess by gravity. The recess opening is then sealed by means of the cover strip.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples

BRIEF DESCRIPTION OF THE DRAWINGS

The invention will be better understood by reading the following description and by reference to the accompanying figures. These are given for guidance and to illustrate examples and are not intended as limiting of the invention. As shown in the figures.

DETAILED DESCRIPTION OF THE PREFERRED EMBODIMENTS

Figure 1:
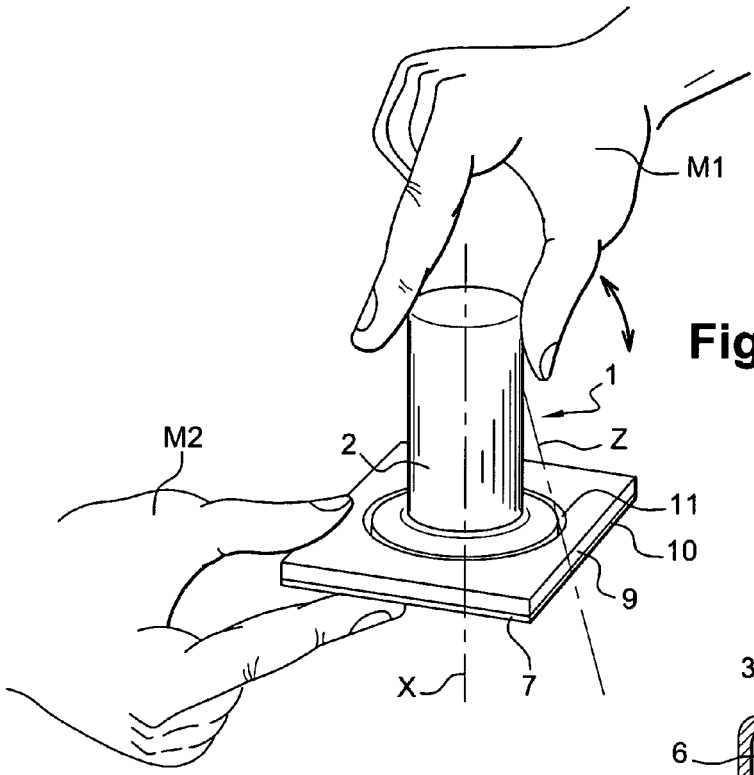
FIG. 1 is a perspective view illustrating the use of a device according to the invention.
Figure 2:
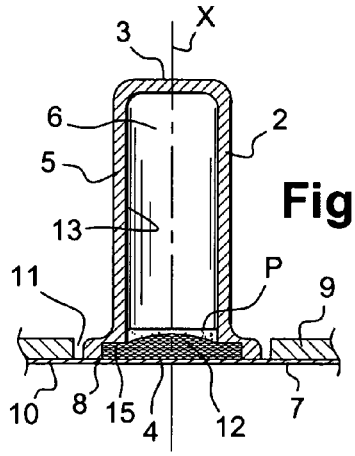
FIG. 2 is a cross-sectional view of a device according to the invention in the sealed position.

FIG. 1 shows a device 1 according to the invention held between the hands M1 and M2 of a user. The device 1 includes a container 2. The container 2 presents a bottom 3 set apart from an opening 4, not shown in FIG. 1. The first hand M1 is placed in proximity to this bottom 3, or at the level of the side walls 5 defining the container 2. The side walls 5 stand relative to the bottom 3 so as to delineate an inner recess 6 of the container 2.

In FIGS. 1 to 4, by way of example, the container 2 in this instance is substantially cylindrical in shape having a lengthwise axis X. The side walls 5 extend in a direction of the lengthwise axis X for example parallel thereto in the illustrated example, and the bottom 3 and the opening 4 are defined substantially perpendicular to the lengthwise axis X.

In the closed position, before first use, the opening 4 is sealed by a cover strip 7. Preferably, the opening 4 is delineated at its periphery by an edge 8 defined substantially in one plane, in this instance perpendicular to the axis X. The cover strip 7 is attached to the edge 8 so as to close off the opening 4. As a variant, with the cover strip 7 being preferably made of a flexible material, the edge 8 can be defined as a non-planar surface.

The cover strip 7 is attached to a support 9 forming a grasping element for the cover strip 7 and is capable of being held in this instance in the hand M2. In the example shown, the support 9 has at least one of its faces 10 extending in a plane in which the opening 4 can be defined. The cover strip 7 is attached to this face of the support 9 and can thus be attached at all points to the edge 8 so as to close off the opening 4 in a sealed manner.

The support 9 extends beyond the outer periphery defined by the container 2. The support 9 extends laterally beyond the outer periphery defined around the opening 4. As a variant, the orientation of the support 9 relative to the container 2 can extend in any direction such that grasping the container 2 in a first hand M1 does not impede grasping the support 9 with the second hand M2.

The support 9 is preferably rigid, in any event being substantially more rigid than the cover strip 7. Because the cover strip 7 is attached to the support 9 in the illustrated example, they then extend parallel to each other. The rigidity of the support 9 is such that when the user is holding the support 9 in one hand M2 by one of its edges, the latter can remain substantially flat and does not deform under the effect of gravity, even when the container 2 is integral with the cover strip 5 and therefore with the support 9. Thus, by way of example, when the support 9 is held parallel to the ground, the container 2 is disposed so that it stands perpendicular to the ground.

In the example shown, the support 9 and the cover strip 7 define the same outline. As a variant, the outline of the cover strip 7 can be smaller than the outline of the support 9, the outline of the cover strip 7 then having as a minimum a dimension counterpart to the outline defined by the edge 8. The support 9 and the cover strip 7 have a rectangular cross-section by way of example, whereas the edge 8 defined in this example is of circular cross-section. In addition, and also by way of example, the circular cross-section covered by the edge 8 is in this instance greater than the transverse cross-section of the container 2 at the level of its side walls 5. As can be appreciated, the support can provide a frame for the cover strip such that movement of the frame will cause movement of the cover strip for removal of the cover strip. As shown in the illustrated examples, the frame can extend around the entire opening of the container.

The thickness of the cover strip 7 is for example between 0.1 mm and 0.5 mm. The cover strip 7 is for example made of aluminium, or a composite of aluminium and a polyolefin, or a composite of aluminium and varnish, or polyethylene terephthalate which may or may not be combined with a varnish or a polyolefin, or a polyolefin which may or may not be combined with a varnish or another polyolefin. The thickness of the support 9 is for example between 0.8 mm and 5 mm. The support 9 is for example made of polyolefin, moldable or cuttable plastic, or metal. The support 9 has for example a surface area on the order of 200 $mm^2$, while a transverse cross-section of the container 2 varies between 10 $mm^2$ at the bottom 3 and 60 $mm^2$ at the level of the opening 8. Preferably, the container 2 is disposed relative to the support such that a portion of the support has a sufficient surface area to be able to be held between at least two fingers of one hand. As a variant, in the case where the support 9 is of small dimensions, the user can hold it between two fingers by the edge on two opposite sides.

The cover strip 7 is for example heat sealed onto one face of the support 9 in an irreversible manner. Heat sealing or heat welding can be accomplished using a varnish (or adhesive) for example, integral with an aluminium film for example to provide the combination forming the cover strip, to bond the cover strip to the support material. Where a varnish is used, it is preferably made of a material that does not require an additional binder in the molten state in order to adhere to the support material. As a variant, it is also possible to thermally bond the cover strip to the support for example by means of a layer of thermofusible glue between the two materials respectively forming the cover strip and the support.

In an embodiment not shown, a face of the cover strip against which the container 2 is attached is opposite a face of the cover strip against which the support 9 is held.

In the examples shown, the support 9 and the container 2 are held on a same face 10 of the cover strip 7. This face of the cover strip 7 is then preferably coated with a heat-sealing resin whereby adhesion of the support 9 and respectively the container 2 can be obtained.

In a preferred manner, the support 9 includes an aperture 11 through which the container 2 is partially mounted so that the cover strip 7 closes off the opening 4 in a sealed manner. Thus, by way of example, the support 9 preferably surrounds the container 2 over its entire periphery. The user is therefore able to choose the grasping zone by which to pick up the support.

The aperture 11 presents a cross-section counterpart to or slightly larger than the cross-section of the container at the level of its side walls 5 adjacent to the opening 4. The cross-section of the aperture 11 in this instance is circular. For example, the difference in diameter between the cross-section of the aperture 11 and the cross-section to the outer periphery of the container at the opening 4 can be on the order of several tenths of a millimeter to provide sufficient play to allow the container to detach from its cover strip without risk of the container becoming stuck through the aperture 11 on passing from a closed condition to an open position for use.

In effect, in the open position, the opening 4 is then accessible. The recess 6 formed by the container 2 holds a measured quantity of product intended to be applied by means of an applicator 12. To this end, the applicator 12 is integral with the container 2 in the illustrated example and closes off the passage defined at the opening 4, so that the product can only be dispensed through this applicator 12. As a variant, the applicator 12 does not completely obstruct the passage defined at the opening 4. In this case, however, the product is preferably held in the pores of the applicator so that even if the detachment of the container from its cover strip takes place with the opening 4 facing downward, the product does not flow out of the container by gravity before it can even be applied.

For example, the applicator can be made of a porous material such as open cell polyethylene foam.

The applicator is for example heat welded to an inner wall 13 of the container 2. For example the applicator can be welded onto a portion 15 of this inner wall set back from the edge 8. Preferably, the applicator 12 is arranged so that it passes through (or partially protrudes through) the opening 4 in the open position. Thus when the user is holding the container 2 in his/her hand, a surface to be treated can be placed in contact with the applicator 12 without bringing the edge 8 into contact with the surface to be treated.

Preferably, the applicator 12 is resiliently deformable so that it is compressed by the cover strip in the recess 6 in the closed position. As illustrated for example in FIGS. 2 to 4, the opening 4 is defined in a plane, and the applicator presents a dome-shaped application surface 14 extending through this opening 4. But when the cover strip 7 is covering the opening 4, the application surface 14 is pressed against the cover strip and, the applicator being in a fixed axial position by virtue of its attachment by welding to the portion 15, it is therefore compressed by the cover strip 7.

Figure 3:
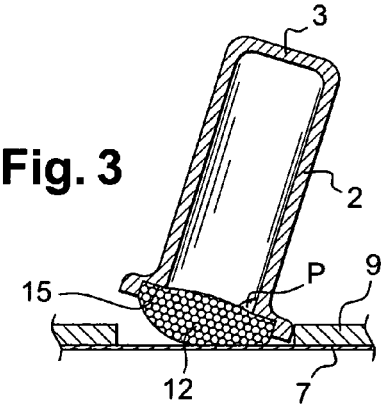
FIG. 3 is a cross-sectional view of a device according to the invention in the process of opening.
Figure 4:
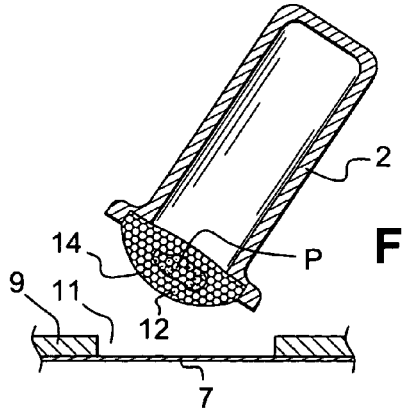
FIG. 4 is a cross-sectional view of a device according to the invention in a position separated from its cover strip.

Thus when the user detaches the container 2 from its cover strip 7, while holding the support 9 in fixed position with the hand M2, a rotational movement is then imparted to the container 2 relative to this support 9 with the hand M1. The rotational movement is for example at least 30° about an axis Z perpendicular to the lengthwise axis X. The rotational movement is obtained by pivoting the container relative to the support 9, the pivot point being located in proximity to the junction between the cover strip 7 and the container 2. The axis Z is then tangent to the outer periphery of the container defined in proximity to this junction. As illustrated in FIG. 3, the applicator 12 then progressively expands as it separates from the cover strip.

As a variant, the applicator 12 can be only partially disposed in the recess 6 in the case where the cover strip is not held taut against the edge 8. As a further variant, the applicator 12 is mounted on a resilient deformable means, for example a spring, such that it can be pushed at least partially into the recess 6 in the closed position, and can protrude at least partially through the opening 4 in the open position. In the latter case, the spring can be mounted integral with the bottom 3 for example, and the applicator 12 held on the spring can be non-deformable.

By way of example, the container 2 holds a quantity of product P, and in the case where the applicator is resiliently deformed in the closed position, this quantity of product P is at the surface of the applicator without being able to enter its pores. But as the applicator is progressively detached from the cover strip 7, the pores recover their shape elastically and progressively pump the product through their structure. The applicator 12 is then "charged" with product and capable of being applied against a surface to be treated in order to dispense said product.

With the applicator integral with the container 2, it is easy to handle and can be manipulated without requiring direct contact with the user's fingers, and the user's fingers can be preferably positioned at the level of the bottom 3 and therefore at some distance from the opening 4.

Figure 5:
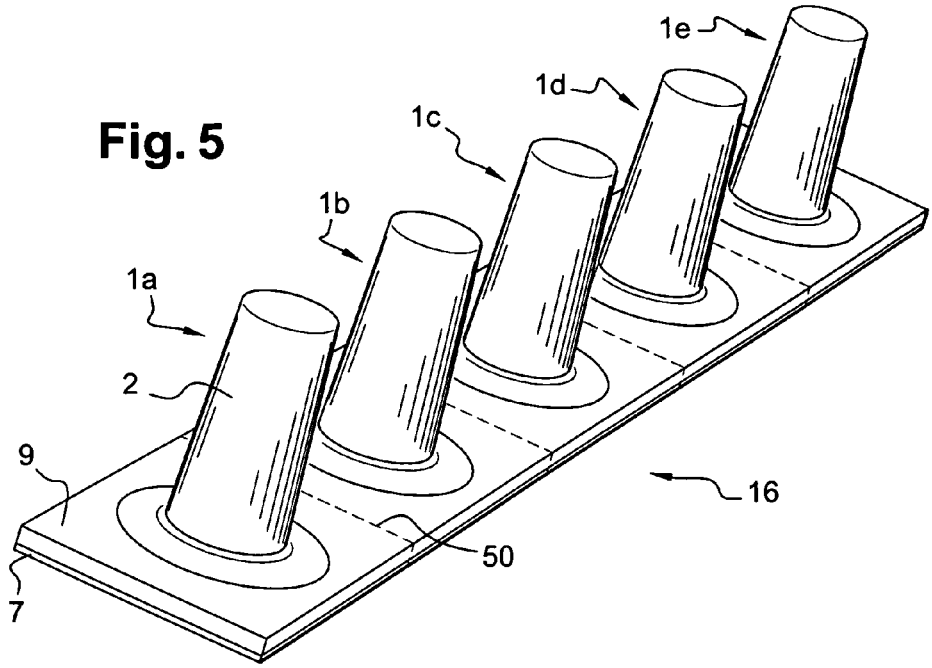
FIG. 5 is a perspective view in elevation of a kit or series of devices according to the invention.

FIG. 5 illustrates a packaging kit or series of devices 16 including in this example five devices 1*a* to 1*e* such as 1 to provide an assembly, with each of these devices respectively including a container such as 2 sealed by a cover strip such as 7, and such that each cover strip is integral with a support such as 9. A kit or assembly according to the invention includes at least two devices such as 1.

In the example shown, the devices 1*a* to 1*e* are connected together in that the supports are respectively arranged in a strip. They are connected at least in pairs in the case of the individual devices at the ends of the strip. The supports can define breakable portions that can be detached from each other at preformed break-off lines such as 50. Preferably, the corresponding cover strips also form a continuous sheet incorporating break zones matching the break-off lines 50 so that they can also separate when one of the devices is detached from the rest of the strip.

Figure 6:
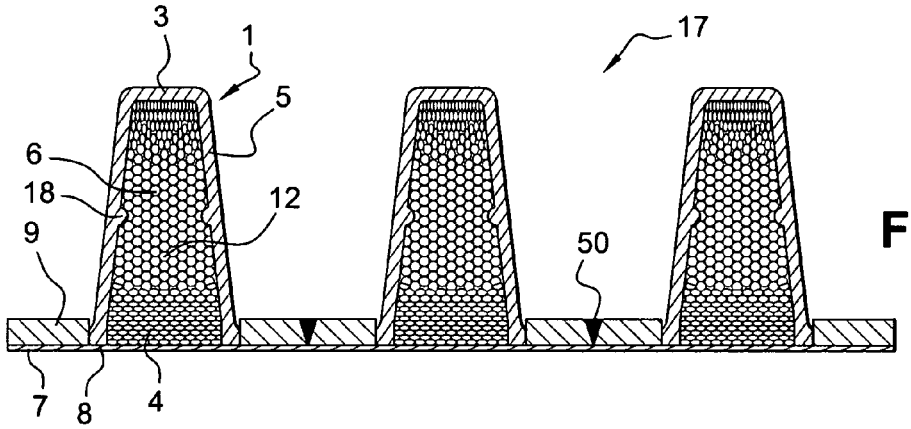
FIG. 6 is a partial cross-sectional view of a kit or series of devices according to the invention.
Figure 7:
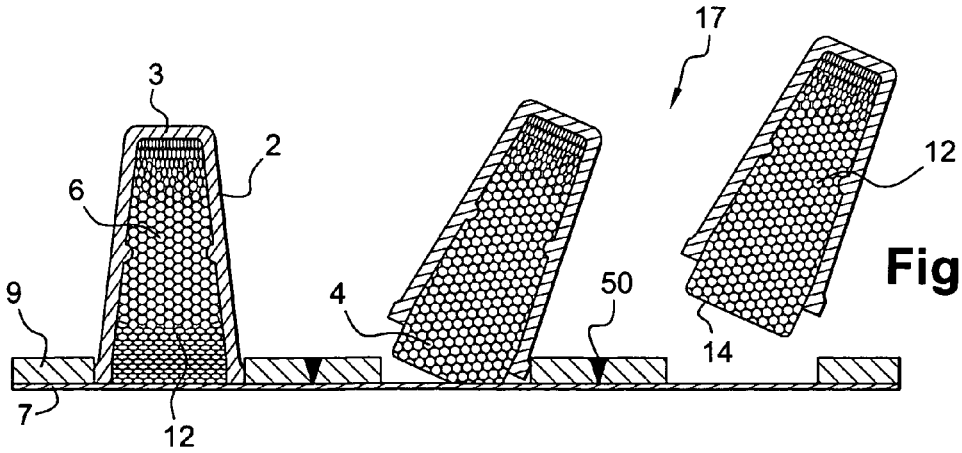
FIG. 7 is a partial cross-sectional view of a kit or series of devices according to the invention wherein the devices are at different stages of opening relative to their respective cover strip.

FIGS. 6 and 7 depict alternative kits 17 including devices according to the invention. In this embodiment, the container 2 is cone-shaped and has an inner recess 6 that is also cone-shaped. For example, the bottom 3 presents the smallest internal cross-section of the recess 6.

For example, the applicator 12 occupies the whole of the internal volume of the recess 6. In the case where the applicator 12 is cylindrical in shape, and in the example where the recess 6 is cone-shaped, a diameter is preferably then chosen so that it is retained by compression in the recess 6, for example at the level of the bottom 3. As a variant, the inner periphery 13 of the recess 6 incorporates grooves 18, for example radial in the example shown, capable of cooperating with the applicator so as to hold it in the recess by radial compression at least at each point of contact with said grooves. As a variant, the grooves can also be longitudinal.

According to FIGS. 6 and 7, the applicator 12 is resiliently compressible. It is radially compressed at least at the level of the bottom 3, and it occupies the entire internal volume of the recess 6, and is compressed axially, in the closed position, along the lengthwise axis X of the container 2. In effect, in this case, the applicator 12 at rest (or uncompressed) has a length greater than a depth of the recess 6 defined from the opening 4 to the bottom 3, these dimensions being established relative to the lengthwise axis X. In fact, as illustrated in FIG. 7, when the container 2 is separated from the cover strip 7, the applicator 12 decompresses axially and emerges from the opening 4 so as to present its application surface 14 in an outwardly protuberant manner.

By virtue of this decompression, the product is pumped through the pores of the applicator to an application surface 14. Furthermore by way of example, with the applicator radially compressed at the level of the bottom 3, the product is not substantially stored at this level.

Preferably, the side walls 5 of the container 2 are resiliently deformable. Thus the user is able to exert pressure on these walls 5, thereby radially compressing the applicator 12 and compelling the product to migrate to the application surface 14.

Throughout the description, the expressions such as "including one," "having one," "comprising one," etc., should be regarded as synonymous with "including at least one," unless otherwise specified.

What is claimed as new and desired to be secured by Letters Patent of the United States is:

1. An applicator and packaging device including:

a container forming a recess containing a measured quantity of product and delineating an opening capable of communicating with said recess;

a cover strip which closes the opening in a closed position, wherein a bond is provided between the cover strip and the container in the closed position such that the cover strip is bonded to the container and the opening is closed, and wherein the cover strip is at least partially removable to place the container in an open position;

a porous applicator coupled to said container, wherein when said opening is closed by the cover strip, the applicator is at least partially disposed in said recess, and wherein the applicator emerges at least partially through said opening when the container is in the open position; and wherein a support is associated with the cover strip, and the support has a greater rigidity than that of the cover strip, and wherein in the closed position, the support extends at least partially around the opening, and wherein the support provides a grasping element which is movable relative to the container, and wherein movement of the support element causes breaking of the bond between the container and the cover strip to open the container.

2. A device according to claim 1, wherein the applicator is resiliently deformable.

3. A device according to claim 2, wherein the applicator is compressed in said recess by said cover strip such that the cover strip is held taut against the applicator in the closed position.

4. A device according to claim 2, wherein a length of the applicator in an uncompressed state is greater than a depth of the recess defined from the opening of said recess.

5. A device according to claim 1, wherein the applicator occupies the entire internal volume of the container.

6. A device according to claim 1, wherein the applicator is an open-cell foam.

7. A device according to claim 1, wherein the applicator has an application surface which forms a dome in the open position.

8. A device according to claim 1, wherein the applicator is welded to a wall of the container.

9. A device according to claim 8, wherein the applicator is welded to the container at a location recessed from an edge of the container delineating the opening.

10. A device according to claim 1, wherein the applicator is held by radial compression inside the recess.

11. A device according to claim 1, wherein the cover strip provides a leaktight closure of the opening.

12. A device according to claim 1, wherein the cover strip is made of a barrier material resistant to the external environment to avoid contamination of the product and the applicator in the sealed position.

13. A device according to claim 1, wherein the cover strip is heat-sealed against the support.

14. A device according to claim 1, wherein the support has an aperture through which the container is mounted to the cover strip such that the container is closed off by the cover strip.

15. A device according to claim 14, wherein the support includes a plurality of apertures and a plurality of containers are respectively positioned in said plurality of apertures to provide a plurality of said containers coupled together to form an assembly, and wherein each of said containers is movable relative to the support to break the bond between the cover strip and the container and allow removal of the container from the support, and wherein upon removal of a container from the support the cover strip remains associated with the support.

16. An assembly according to claim 15, wherein one or more breakable portions are defined in the support.

17. An assembly according to claim 15, wherein the cover strip is bonded to at least two of said containers, and further wherein upon removal of each container through a respective aperture the cover strip remains connected to the support and closes the aperture of the support on a side of the support opposite a side through which the container passes to remove the container.

18. A device according to claim 14, wherein the support aperture includes an inner periphery which is larger than an outer periphery of the container at a level of the opening to thereby allow relative movement between the container and the support.

19. A device according to claim 18, wherein the inner periphery of the support aperture is spaced from and does not contact the outer periphery of the container in the closed position.

20. A device according to claim 19, wherein the bond between the container and the cover strip is provided by at least one of a heat seal or an adhesive.

21. A device according to claim 18, wherein the shape of the inner periphery of the aperture of the support and the shape of the outer periphery of the container is circular.

22. A device according to claim 1, wherein the container includes resiliently deformable walls.

23. A device according to claim 1, wherein the container includes retaining means capable of cooperating with the outer periphery of the applicator.

24. A device according to claim 1, wherein the container contains a measured quantity of product which is between 0.5 and 20 mL.

25. A device according to claim 1, wherein the container contains a measured quantity of product which is less than 1 ml.

26. A device according to claim 1, wherein the product is impregnated in the applicator.

27. A device according to claim 1, wherein the product includes at least one component of a formulation for coloring keratinic fibers.

28. A device according to claim 1, wherein the product is a hair product.

29. A device according to claim 1, wherein the container is opened by a rotational movement imparted to the container relative to the support.

30. A device according to claim 29, wherein the rotational movement is a tilting movement about a first axis parallel to the support, so as to detach the cover strip from the opening, and wherein after opening an application surface of the applicator projects beyond the opening, and further wherein the container has a second axis extending in a longitudinal direction of the container, and wherein the first axis is perpendicular to the second axis.

31. A device according to claim 1, wherein at least part of the support extends around the entire opening.

32. A device according to claim 31, wherein the support is attached to the same side of the cover strip which closes the opening.

33. A device according to claim 31, wherein the support is attached to a side of the cover strip opposite to a side which closes the opening.

34. A device according to claim 1, wherein said support forms a frame which is associated with said cover strip such that movement of said frame causes the cover strip to move with the frame to remove the cover strip from the container.

35. An applicator and packaging device including:

a container forming a recess containing a measured quantity of product and delineating an opening capable of communicating with said recess;

a cover strip which closes the opening in a closed position, wherein a bond is provided between the cover strip and the container in the closed position such that the cover strip is bonded to the container and the opening is closed, and wherein the cover strip is at least partially removable to place the container in an open position;

wherein a support is associated with the cover strip with the support forming a frame with at least part of the frame extending around the entire opening of the container in the closed position, wherein the frame has a greater rigidity than that of the cover strip, and wherein the cover strip moves with the frame such that movement of the frame causes movement of the cover strip to break the bond between the container and the cover strip to at least partially remove the cover strip from the container and open the container.

36. A device according to claim 35, wherein the bond between the container and the cover strip is provided by at least one of a heat seal or an adhesive.

37. A device according to claim 35, wherein:

said support includes first and second faces on opposite sides thereof;

said support includes an aperture extending through said support from said first face to said second face;

said cover strip is connected to said second face and closes said aperture on said second face;

in the closed position said container is positioned in said aperture and extends out of said aperture on the first face of the support; and wherein upon opening of said container, said container is removed from said aperture through the first face of the support and wherein after opening of the container the cover strip remains connected to the second face of the support with the aperture closed on the second face of the support.

38. A device according to claim 37, wherein in the closed position the second face of the aperture is substantially coplanar with said opening of said container.

39. A device according to claim 38, wherein the container has a longitudinal axis which extends perpendicular to said first and second faces of the support.

40. A device according to claim 35, wherein the support includes a plurality of apertures and a plurality of containers are respectively positioned in said plurality of apertures to provide a plurality of said containers coupled together to form an assembly, and wherein each of said containers is movable relative to the support to break the bond between the cover strip and the container and allow removal of the container from the support, and wherein upon removal of a container from the support the cover strip remains associated with the support.

41. An assembly according to claim 40, wherein the cover strip is bonded to at least two of said containers, and further wherein upon removal of each container through a respective aperture the cover strip remains connected to the support and closes the aperture of the support on a side of the support opposite a side through which the container passes to remove the container.

42. A device according to claim 35, further including an applicator disposed inside of said container.

43. A device according to claim 42, wherein said applicator is at least partially compressed prior to opening of said container.

44. A device according to claim 43, wherein after opening of said container said applicator at least partially projects out of said container.

45. A device according to claim 44, wherein said frame includes an aperture through which the container is mounted to the cover strip to seal the opening with the cover strip.

46. A device according to claim 1, wherein the bond between the container and the cover strip is provided by at least one of a heat seal or an adhesive.

47. A device according to claim 1, wherein:

said support includes first and second faces on opposite sides thereof;

said support includes an aperture extending through said support from said first face to said second face;

said cover strip is connected to said second face and closes said aperture on said second face;

in the closed position said container is positioned in said aperture and extends out of said aperture on the first face of the support; and wherein upon opening of said container, said container is removed from said aperture through the first face of the support and wherein after opening of the container the cover strip remains connected to the second face of the support with the aperture closed on the second face of the support.

48. A device according to claim 47, wherein in the closed position the second face of the aperture is substantially coplanar with said opening of said container.

49. A device according to claim 48, wherein the container has a longitudinal axis which extends perpendicular to said first and second faces of the support.

* * * * *